US005097636A

United States Patent [19]

Crouch et al.

[11] Patent Number: 5,097,636

[45] Date of Patent: Mar. 24, 1992

[54] EDGE BELT SANDER WITH SWINGABLE DUST HOOD

[75] Inventors: Robert H. Crouch; Eugene M. Hoganson, both of West End, N.C.

[73] Assignee: Crouch Machinery, Inc., Pinehurst, N.C.

[21] Appl. No.: 604,017

[22] Filed: Oct. 26, 1990

[51] Int. Cl.[5] ..... B24B 21/10; B24B 55/06

[52] U.S. Cl. ..... 51/273; 271/137; 271/135

[58] Field of Search ..... 51/273, 271, 268, 135, 51/137

[56] References Cited

U.S. PATENT DOCUMENTS

| | | | |
|---|---|---|---|
| 760,834 | 5/1904 | Yarnell | 51/135 R |
| 1,791,917 | 2/1931 | Winsor | 51/273 |
| 2,232,149 | 10/1937 | Tautz | 51/135 |
| 2,419,744 | 4/1947 | Thwaites | 51/273 |
| 3,812,622 | 5/1974 | Parsons | 51/5 |
| 3,872,627 | 3/1975 | Schuster | 51/273 |
| 4,151,705 | 5/1979 | Evans | 51/273 |
| 4,228,618 | 10/1980 | Jensen | 51/273 |
| 4,403,534 | 10/1983 | Altendorf et al. | 83/100 |
| 4,525,955 | 7/1985 | Cothrell et al. | 51/135 |
| 4,528,743 | 7/1985 | Bleich | 29/568 |
| 4,750,536 | 6/1988 | Grisley | 144/251 |

*Primary Examiner*—Robert A. Rose

*Attorney, Agent, or Firm*—Watson, Cole, Grindle & Watson

[57] ABSTRACT

A swingable dust hood is provided for use in the dust removal system of an endless belt type working machine. The dust hood has a jet air cleaner positioned on an inner wall which blows dust and other particles off the workpiece for exhaust via an outlet connected to the dust hood. A pivot rod is fixed to the outer shell of the dust hood and is rotatably journalled in a pivot receptacle bracketed to the machine support table. The hood can accordingly be positioned in three primary positions; namely, a first position wherein the hood completely encases a roll when the workpiece does not extend past the form platen; a second position wherein the hood partially encloses the piece when the workpiece is extended past the platen; and a third position wherein the hood is swung back to completely expose the drive roll to permit changing or repair of the endless belt and/or the roll.

2 Claims, 2 Drawing Sheets

EDGE BELT SANDER WITH SWINGABLE DUST HOOD

BACKGROUND OF THE INVENTION

1. Technical Field of the Invention

The present invention relates generally to a dust hood for an endless belt type working machine, and more particularly to such a dust hood which is swingable away from the endless belt to permit over-sized workpieces to contact the belt and to permit access to the roller when changing belts.

2. Discussion of the Related Art

Endless belt type working machines perform a wide variety of functions on a workpiece including sanding, grinding, buffing, polishing, form shaping, etc. Basically, contact between the driven, abrasive endless belt and the workpiece is adjusted to the desired degree and position by either changing the position of the workpiece by adjusting a supporting table relative to the belt or by adjusting the belt relative to the workpiece via a form platen. This contact removes a certain amount of material from the workpiece depending on such factors as the belt speed, belt abrasiveness, pressure applied to the workpiece against the belt, etc. The resulting removed material or dust poses a significant health risk to workers and a cleaning problem both to the general working environment and to sensitive machinery.

Currently, removal systems comprising a dust hood and vacuum collectors are used to draw the dust from the workpiece to the outside. While these removal systems effectively reduce dust, they often interfere with the operation of the endless belt machine due to the close, and often fixed, position of the dust hood relative to the belt and/or work piece. Specifically, working on pieces longer than the belt face or form platen, i.e., pieces which would extend past the point when the hood covers the belt, is difficult and often impossible since the dust hood is often positioned near one end of the loop near a roller. Also, this position complicates changing the belt as particular job requirements for belt width, abrasiveness, etc. change. U.S. Pat. No. 2,232,149 discloses a hood having a pivotally connected dust deflector which forms a scoop for dust and which is capable of being swung downwardly and to the level of the working table so as not to interfere with the work. However, belt changing is difficult since the deflector edge is still near the belt even in the downward position.

Accordingly, it is an object of the present invention to provide a dust hood for an endless type belt machine which allows work on various shaped workpieces.

It is another object of the present invention to permit access to the belt and roller while removing dust during operation of an endless belt type working machine.

It is a further object of the present invention to accomplish the foregoing objects simply and inexpensively.

Further objects and advantages of the present invention are apparent from the drawings and specification which follow.

SUMMARY OF THE INVENTION

The foregoing and additional objects are obtained by a dust hood according to the present invention. A swingable dust hood is provided for use in the dust removal system of an endless belt type working machine. The dust hood has a jet air cleaner positioned on an inner wall which blows dust and other particles from the belt to an exhaust outlet connected to the dust hood. A pivot rod is fixed to the outer shell of the dust hood and is rotatably journalled in a pivot receptacle bracketed to the machine support base. The hood can accordingly be positioned in three primary positions; namely, a first position wherein the hood completely encases the drive roll when the workpiece does not extend past the form platen; a second position wherein the hood partially encloses the drive roll when the workpiece extends past the platen; and a third position wherein the hood is swung back to completely expose the roll to permit changing or repair of the endless belt and/or the roll.

DETAILED DESCRIPTION OF THE PREFERRED EMBODIMENTS

Figures 1, 2:
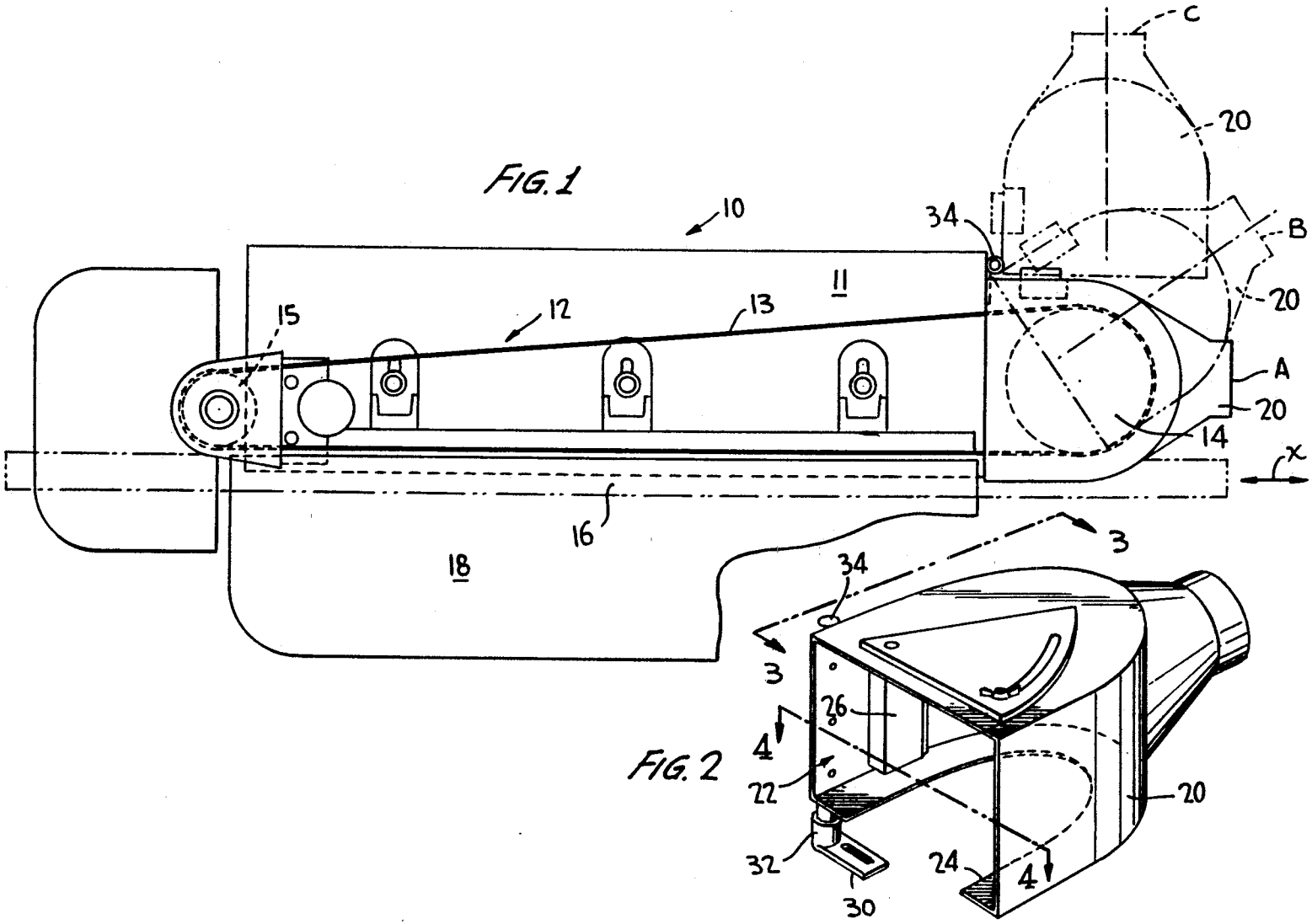
FIG. 1 is a top view of an edge belt sander equipped with a dust hood cover according to the present invention.
FIG. 2 is a perspective view of the dust hood cover according to the present invention.
Figure 3:
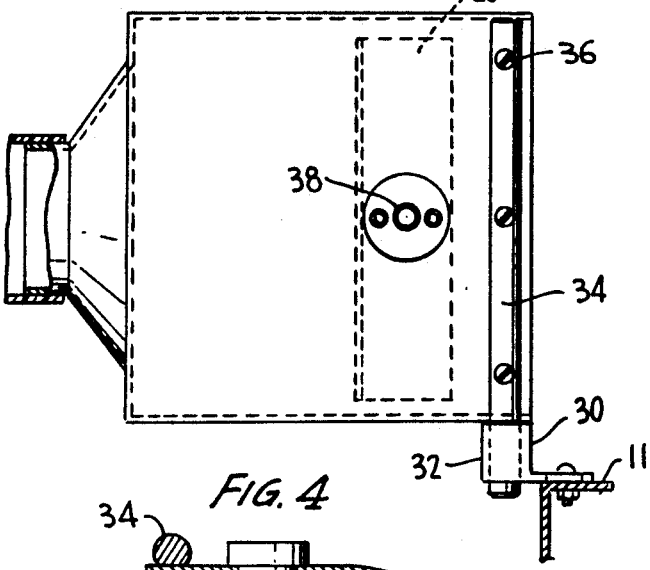
FIG. 3 is a sectional view taken along line 3—3 of FIG. 2.

Referring now to FIG. 1, wherein like reference characters refer to like and corresponding parts throughout the several views, a belt apparatus is generally designated 10 and 12 includes a support base 11 to which an endless belt type working machine 12 is mounted in any normal manner. The belt working machine 12 includes an endless abrasive belt 13 trained over both a drive roll 14 and a driven idler roll 15, each suitably mounted on the frame for rotation about fixed upstanding axes. A drive motor is operatively coupled to drive roll 14. The support base includes a standard backup platen a normally mounted thereon over which the belt passes during either its clockwise or counterclockwise movement between the rolls, as viewed in FIG. 1. The platen is typically elongated in the longitudinal travel direction of the belt, and an elongated workpiece support table 18 is located along a side of the base at a working side of the belt, as shown.

The desired workpiece 16, e.g., wood, plastic, metal or any other material, is placed on support table 18 in suitable contact with belt 13 for sanding, grinding, polishing, buffing, form shaping, etc. In essence, the principle task of an endless belt type working machine is to remove material from a workpiece. For example, an existing profile may be smoothed by altering the dimensional integrity of the workpiece by removing an equal amount of material from all surfaces of the profile. In addition, a new profile may be generated by removing different amounts of material from various parts of the profile.

The workpiece is fed against the outer face of belt 13 via two distinct actions. First, the workpiece can be thrust against the face of the endless belt without imparting any lateral motion to the workpiece, i.e., without moving the workpiece along the direction of belt travel or oppositely thereto. Such an action is commonly termed plunge or infeed sanding or working. Alternatively, the workpiece may be plunged or infed while simultaneously imparting lateral motion to the part in either the direction of belt or in the opposite direction. This type of feeding is commonly termed traverse or through-feed sanding or working and is denoted by double-ended arrow X in FIG. 1.

As shown in FIGS. 1 and 2, a dust hood 20 is provided for removing dust and other waste particles generated by the working of piece 16. The dust hood 20 comprises an open face 22 which encloses or encases either drive roll 14 or driven roll 15 when the hood is in position A as shown in FIG. 1. The dust hood 20 also has a horse-shoe shaped bottom plate 24 which allows the dust hood to be positioned about the intended roll such that this roll is enclosed by the hood except for open face 22. The dust hood interior narrows towards the side opposite open face 22 and is connected at this opposite side to an outlet connected to an exhaust conduit (not shown) leading to the outside or to a suitable filtering device.

An air jet cleaner 26 is located in the hood interior on a dust hood inner wall. Any conventional air compressor may be employed which provides an adequate supply of forced air on the belt to blow dust or other removed particles to the exit conduit. This forced air removes and carries dust from the workpiece, belt and associated components to the outlet of the hood.

The dust hood 20 is designed to be pivotable and positionable about an axis which is perpendicular both to the direction of travel of belt 13 and to the upper surface of base 11 in order to provide optimal positioning of the hood. A bracket 30 is attached to the base top opposite the working side of the belt and closest to the desired roll, e.g., drive roll 14, by any suitable means such as screws. A cylindrical pivot receptacle 32 is connected to bracket 30. To increase manufacturing efficiency, pivot receptacle 32 and bracket 30 may be integrally formed with one another. A pivot rod 34 is connected to a side of the dust hood 20 via appropriate means such as screws 36 and is rotatably journalled within pivot receptacle 32. Accordingly, the dust hood may be pivoted about the symmetry axis of pivot rod 34 as the rod and hood are manually or otherwise rotated within pivot receptacle 32. Referring once again to FIG. 1, this pivoting allows dust hood 26 to optionally occupy at least three positions. Position A allows for a dust removing operation of the air jet cleaner when the workpiece does not extend past the end of the form platen by completely encasing drive roller 14 and consequently covering the portion of the dust generating belt 13 trained about this roller. Position B allows for a dust removal operation of the air jet cleaner when the workpiece extends past the platen. Position B is defined such that the corner of the hood, i.e., the edge of open face 22, which is opposite the location of the pivot rod 34 abuts the portion of workpiece 16 which extends past the platen, thereby ensuring maximum possible enclosure by the dust hood of the drive roll 14 and the belt 13 trained thereon while permitting over-sized workpieces to be sanded, polished or worked in any other desired manner via traverse through feeding. Finally, position C permits access to belt 13 and roller 14 to accomplish belt and/or roller changes, replacements and repair.

Figure 4:
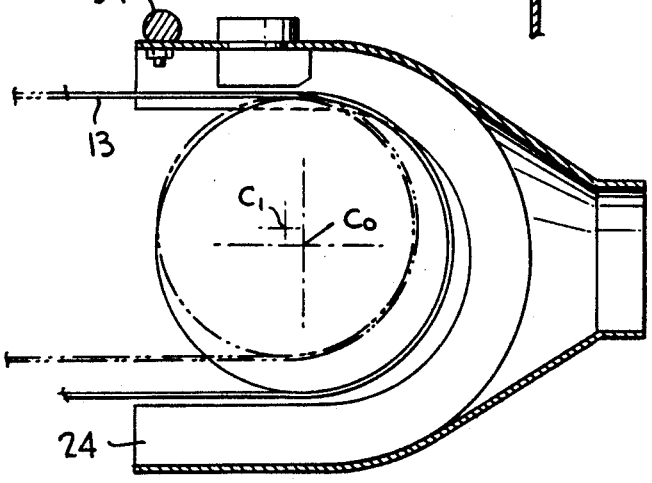
FIG. 4 is a sectional view taken along line 4—4 of FIG. 2.

It is sometimes desired to replace the covered roller, e.g., roller 14, with another roller which has a larger or smaller diameter when a belt speed change is required. Regardless of the roller diameter selected, it is advantageous to maintain a specific distance d between the air jet cleaner 26 and the belt 13 trained over the covered roller in order to ensure efficient dust removal. To maintain this distance, the center rotational axis of the pivot rod 34 must be shifted either towards or away from drive roller 14 as the roller diameter is smaller or larger. This relationship is shown in FIG. 4 wherein the dashed line represents a smaller diameter roller, $C_1$, represents it's rotational center, and Co represents the rotational center of the larger diameter roller.

The respective sizes of the roll diameter, belt width, hood interior and pivot rod length are correlated at all times to achieve maximum dust removal while maintaining optimal working of the workpiece.

Figure 5:
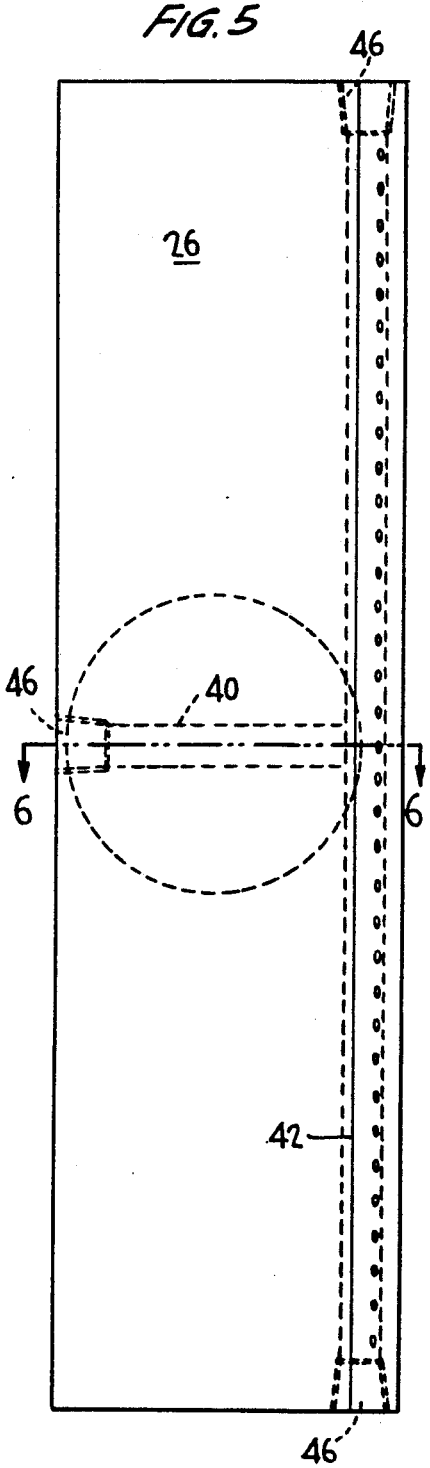
FIG. 5 is a side view of an air jet cleaner for use in the present invention.
Figure 6:
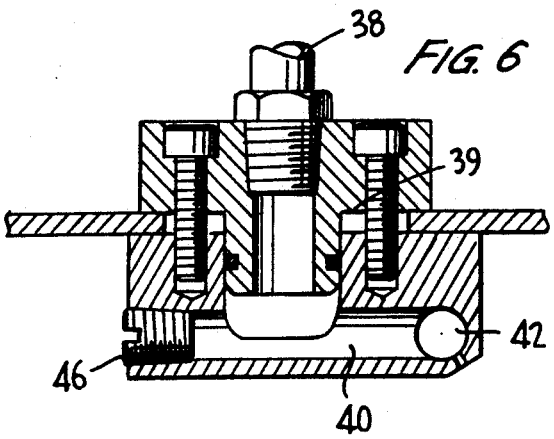
FIG. 6 is a sectional view taken along line 6—6 of FIG. 5.

A preferred air jet cleaner 26 is shown in FIGS. 5 and 6. An air supply tube 38 feeds into a supply passage 40 via an inlet passage 39. Supply passage 40 in turn connected to a passage 42 extending along the length of the air jet cleaner. Passage 42 has a plurality of evenly spaced air holes 44 for directing air toward the workpiece and belt. Caps or plugs 46 are provided at the opposite ends of passage 42 and at the end of passage 40 to close the passage environment except for the air holes.

Many modifications, substitutions and improvements will be apparent to one skilled in the art without departing from the spirit and scope of the present invention as described and defined in the specification and the following claims.

We claim:

1. A swingable dust hood for an endless belt type working machine, the working machine comprising a support base, an endless belt trained over both a drive roll and a driven roll located on an upper surface of the support base, a workpiece support table mounted on said base along a working side of said belt, the belt travelling in a predetermined direction, the dust hood comprising;

a dust hood body having a dust exit conduit and an open face and walls completely encasing one of said rolls in a first position of said hood, air jet cleaner means mounted within said hood for directing air against the belt to blow any dust or other removed particles toward said exit conduit;

a pivot receptable connected to said support base at a side of said belt opposite said working side;

a pivot rod journalled in said receptable and being connected to a sidewall of said hood body adjacent said open face, said pivot rod extending perpendicular to said support base;

said hood being pivotally movable about the axis of said rod to a second position to avoid interference with a workpiece extending beyond an end of said support table, said hood at least partially encasing said one roll in said second position such that said cleaner means directs air against said belt to blow any dust or other removed particles toward said exit conduit; and said hood being pivotally moveable about said rod axis to a third position uncovering said one roll to permit access to said belt and said one roll.

2. The dust hood according to claim 1, wherein said body includes a horse-shoe shaped bottom wall to facilitate location of said hood in said first and second positions.

* * * * *